US006645324B2

(12) United States Patent
Hirata et al.

(10) Patent No.: US 6,645,324 B2
(45) Date of Patent: Nov. 11, 2003

(54) METHOD OF MANUFACTURING A FERRITIC STAINLESS STEEL PLATE

(75) Inventors: Norimasa Hirata, Chiba (JP); Takeshi Yokota, Chiba (JP); Yasushi Kato, Chiba (JP); Takumi Ujiro, Chiba (JP); Susumu Satoh, Chiba (JP)

(73) Assignee: Kawasaki Steel Corporation, Tokyo (JP)

( * ) Notice: Subject to any disclaimer, the term of this patent is extended or adjusted under 35 U.S.C. 154(b) by 0 days.

(21) Appl. No.: 10/103,445

(22) Filed: Mar. 21, 2002

(65) Prior Publication Data

US 2002/0144756 A1 Oct. 10, 2002

Related U.S. Application Data

(62) Division of application No. 09/725,624, filed on Nov. 29, 2000, now Pat. No. 6,383,309.

(30) Foreign Application Priority Data

Dec. 3, 1999 (JP) ..... 11-345449
Feb. 24, 2000 (JP) ..... 2000-47789

(51) Int. Cl.[7] ..... C21D 8/02
(52) U.S. Cl. ..... 148/651; 148/610
(58) Field of Search ..... 148/651, 610

(56) References Cited

U.S. PATENT DOCUMENTS 5,505,797 A * 4/1996 Yokota et al. ..... 148/610

* cited by examiner

*Primary Examiner*—Deborah Yee
(74) *Attorney, Agent, or Firm*—Piper Rudnick LLP

(57) ABSTRACT

A ferritic stainless steel plate of excellent ridging resistance and formability, as well as a manufacturing method thereof are proposed. Specifically, the rolling is conducted at a rolling reduction of 30% or more in at least 1 pass and at a temperature difference between the center of the plate thickness and the surface of 200° C. or lower in a pass for the maximum rolling reduction to cause the area ratio of a {111} orientation colony to be present by 30% or more in the regions of 1/8 to 3/8 and 5/8 to 7/8 of the plate thickness. The {111} orientation colony is an assembly of adjacent crystals in which the angle of <111> orientation vector for each of the crystals relative to the direction vector vertical to the rolling surface is within 15°.

6 Claims, 6 Drawing Sheets

METHOD OF MANUFACTURING A FERRITIC STAINLESS STEEL PLATE

This application is a divisional of application Ser. No. 09/725,624, filed Nov. 29, 2000, incorporated herein by reference, which is now U.S. Pat. No. 6,383,309, issued May 7, 2002.

BACKGROUND OF THE INVENTION

1. Field of the Invention

This invention concerns a ferritic stainless steel plate and a manufacturing method and, more in particular, it relates to a ferritic stainless steel plate which, throughout this specification and claims also includes steel strip, the plate having excellent ridging resistance and formability such as press workability and bendability.

2. Description of the Related Art

Ferritic stainless steels have been utilized in various fields such as kitchen utensils or automobile parts since they resist formation of stress corrosion cracks, and are inexpensive, and have improved deep drawing properties and ridging resistance.

As the field of use for the ferritic stainless steels has been extended, more stringent standards have been demanded also for other types of formability characteristics, such as bulging properties or bendability, in addition to deep drawing properties and ridging resistance. The bulging property of the plate is a measure of how much a central portion of the plate can be bulged without breakage when it is bulged by pressing with the plate ends constrained. This is indicated by the bulging height, which is distinguished from the deep drawing property (evaluated as the "r value") by pressing without constraining the plate ends.

For improving the deep drawing properties and ridging resistance of the ferritic stainless steels, a technique for controlling colonies in the steel plates has been proposed recently.

According to the studies so far on colonies which are defined as groups of crystal grains having identical orientation, it has been considered most effective for the improvement of ridging resistance to make the colony smaller. For example, Japanese Patent Laid-Open NO. 330887/1998 discloses a method of improving ridging resistance by defining the length of the colony in the direction of the plate thickness within an RD (rolling direction as shown in FIG. 6, hereinafter simply referred to as the RD) plane to 30% or less of the plate thickness, thereby reducing the size of the colony in the direction of the plate thickness, and improving the deep drawing properties by defining the volumetric ratio of a {111} orientation colony to 15% or more, as shown in FIG. 6.

On the other hand, there has been an attempt of utilize specified colonies. For example, Japanese Patent Laid-Open No. 263900/1997 discloses the technique of defining the size of the {111} orientation colony in the direction of the plate width to 100–1000 $\mu$m, thereby improving the ridging resistance of the plate and increasing the ratio of the {111} orientation colony in the direction of the plate width to improve the deep drawing property (r value).

In any of the methods described above, it is intended to improve the deep drawing property (r value) by causing a great amount of the {111} orientation colony to exist, and to improve the ridging resistance of the plate by making the size of the {111} orientation colony smaller.

However, although the deep drawing property and the ridging resistance can be improved by the techniques described above, it is difficult to remarkably improve also the bulging property of the plate. Japanese Patent Laid-Open No. 310122/1995 discloses a technique of improving ridging resistance together with pressing workability. This intends to improve the deep drawing property (r value), the ridging resistance and the bulging property together by controlling the temperature for at rough rolling (1000 to 1150° C.), friction coefficient (0.3 or less), rolling reduction (40–75%) and strain rate (7–100 l/s) thereby promoting recrystallization at the center of the plate thickness. However, even this technique can not effectively cope with the demand for large bulging capability in recent years.

On the other hand, since cracks have sometimes occurred upon severe bending of stainless steel plates, the bending resistance has also become one of the important characteristics required. Cracks upon bending have been discussed mainly in view of non-metal inclusion in the steels. Particularly it has been known that "A type inclusions" (No.3132 defined by JIS (Japanese Industrial Standard) G0202) extended in the rolling direction, located just beneath the surface of the steel plates, give undesired effects ("Iron and Steel" by Otake, et al, 46 (1960), p. 1273). For instance, Japanese Patent Laid-Open No. 239600/1993 discloses a method of improving bendability by replacing A type inclusions suffering from work-induced plastic deformation with "C type inclusions" (No.3134 defined by JIS G0202) such as granular oxides dispersed irregularly in the steels with no plastic deformation. Further, Japanese Patent Laid-Open No. 306435/1993 discloses a method of attaining improvement of the bendability characteristics by making the purity higher, such as Fe+Cr≧99.98 wt % in Fe—Cr alloys.

Further, Japanese Patent Laid-Open No. 104818/1974 discloses a technique of improving bendability by controlling chemical compositions as Mn/Si≧1.4 and decreasing $MnO{\cdot}SiO_2$ type inclusions.

However, since each of the techniques described above is a method of controlling the ingredients in the steels, it involves a problem of increasing production cost and production and, thus, resulting in reduction of productivity.

In view of the above, it is an object of this invention to overcome the problems in the prior art described above, and to create a ferritic stainless steel plate having excellent ridging resistance and formability (such as deep drawing, bulging and bendability), as well to provide a novel manufacturing method.

This invention further has, as an object, to provide a ferritic stainless steel plate having excellent ridging resistance and formability, as well as a manufacturing method, with no particular requirement of special chemical compositions such as reduced content of C or N, addition of Ti or Nb, high purification or control of the Mn/Si rates.

SUMMARY OF THE INVENTION

We have carefully studied the relationship between the ridging and the crystal orientation distribution in the direction of the plate thickness, for attaining the foregoing purpose. As a result, we have discovered a new way of improving ridging resistance and formability (such as the deep drawing, bulging and bendability) of general purpose ferritic stainless steel plates typically represented by SUS430 and the like. We have discovered that it is important to positively utilize a {111} orientation colony and, particularly, that it is extremely effective to control the colony in a specified position within the transverse direction (TD) plane of the plate, hereinafter simply referred to as the TD plane. It is important, specifically, to distribute more {111} orientation colonies in the two regions which comprise ⅛ to ⅜ and ⅝ to ⅞ of the plate thickness, in which columnar crystals are formed within the cross section in the direction of the plate thickness. Further, it has also been found that plate bendability is further improved by controlling the mean crystal grain size of the steel within a predetermined range.

(1) The ferritic stainless steel plate of this invention has the following characteristics:

The area ratio of {111} orientation colonies, defined as below measured, in the cross section in the direction of the plate thickness cut into a rolling direction, is defined to be about 30% or more in the regions extending from ⅛ to ⅜, and the regions extending from ⅝ to ⅞ of the plate thickness within the cross section, in the direction of the plate thickness: The {111} orientation colony is an assembly of adjacent crystals in which the angle α of the <111> direction vector of each crystal relative to the orientation vector vertical to the rolling surface, is within 15°. That is shown as the orientation of the normal direction in FIG. 6, hereinafter referred to as the "ND" orientation.

The rolling surface indicates the surface of the rolling material. Referring to FIG. 6, this is a surface in parallel with the ND plane, which indicates the top surface or bottom surface of the rolling material.

(2) A ferritic stainless steel plate having excellent ridging resistance and formability as defined in (1) above, wherein the mean crystal grain size is from about 3 to 100 μm, preferably, about 3 to 60 μm.

(3) A method of manufacturing a ferritic stainless steel plate having excellent ridging resistance and formability by rough rolling and finish rolling slabs in hot rolling, applying annealing and cold rolling to the hot rolled plates and then applying finish annealing, wherein the rough rolling is conducted at a rolling reduction in at least one pass in the rough rolling step of the hot rolling of about 30% or more, and at a temperature difference, between the center of the plate thickness and the plate surface, of about 200° C. or lower in the pass where the rolling reduction is maximum.

DESCRIPTION OF THE PREFERRED EMBODIMENTS

Figure 1:
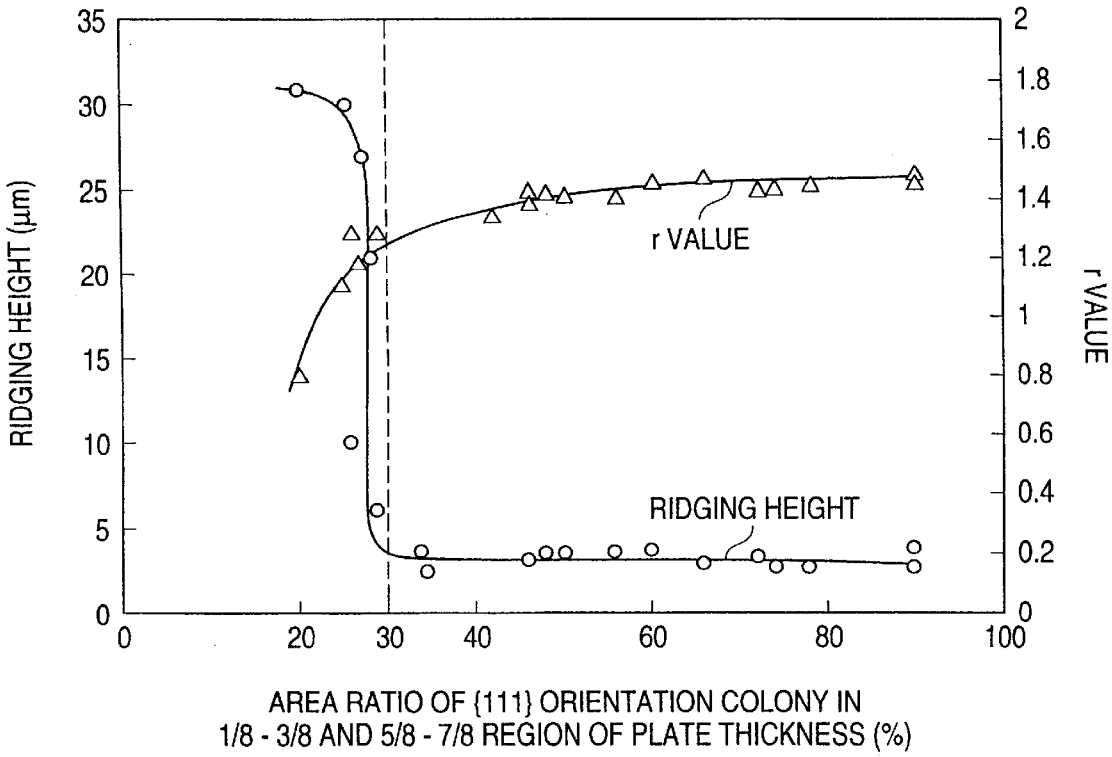
FIG. 1 is a graph illustrating the relationship between the area ratio of the {111} orientation colony in the regions of ⅛ to ⅜ and ⅝ to ⅞ of a plate thickness, and the "r value" and ridging height.

Results of experiments are now described. After preparing ferritic stainless steels comprising the chemical compositions shown in Table 1 by melting, they were each formed into continuously cast slabs of 200 mm thickness, heated to 1170° C. and then subjected to hot rolling comprising 6 passes of rough rolling and 7 passes of finish rolling, to prepare hot rolled plates having 4.0 mm thickness. In this case, the maximum rolling reduction in the rough rolling procedure was within the range from 24 to 63%, and the temperature difference between the center of the plate thickness and the surface of the plate just before the nip of the roll was changed within a range lower than 233° C. The temperature difference between the center of the plate thickness and the surface of the steel plate was controlled mainly by controlling the amount of cooling water for descaling, within a range from 0 to 6800 liters/min/m. The rough hot rolling was conducted with a roll diameter of 500 to 1500 mm and at a roll speed ranging from 50 to 500 m/min. Then, hot rolled plates were annealed at 850° C. for 8 hours or at 900 to 960° C. for one min, cold rolled, and then subjected to finish annealing at 598 to 1125° C. for 324 sec or less, to prepare cold rolled annealed plates having 0.6 mm plate thickness.

Since surface and internal temperatures of the steel plate during hot rough rolling cannot be measured actually, evaluation was based on heat conduction measurements using the differentiation method that has been adopted generally. According to the differentiation method, it has been known to those skilled in the art that the surface temperature and the inner temperatures of the steel plate after lapse of optional time can be determined exactly by using the actually measured temperature of the surface of the steel plate, the size of the steel plate before and after rolling, the roll diameter, the amount of cooling water, the heat conduction coefficient between the steel plate and the roll and the heat conduction coefficient between the steel plate and the cooling water. The actual measured value of the internal temperature of the steel plate can be measured by embedding thermocouples in the body of the steel plate. It has been confirmed that this measured value approximately agrees, with a high degree of accuracy, with the value calculated in accordance with the heat conduction differentiation method.

In this invention, the surface and internal temperatures of the steel plate during hot rough rolling were determined by using a temperature forecasting model (Reference literature: by Devadas. C. M., & Whiteman, J. A.: Metal Science, 13 (1979), p 95) while considering the material temperature (Reference literature; "Journal of the Japan Society for Technology of Plasticity" by Okado, vol.11 (1970) p 816-), the roll temperature (Reference literature: "Iron and Steel", by Sekimoto, et al, 61 (1975), p 2337–2349) and the rolling load (Reference literature "Theory and Practice of Plate Rolling" published from Nippon Tekko Kyokai; Japan Steel Association (1984) p 36–37). Concretely, the temperature of the plate surface before hot rough rolling was determined by heat conduction differentiation based on the heating pattern in a furnace starting from the value actually measured for the slab surface temperature by a radiation thermometer just before charging into the heating furnace. The mean value was actually measured at three points, that is, at the center of the slab width and at about 200 mm positions each from the ends of the slab in the width direction of the slab in the longitudinal central portion of the slab, to extraction from the heating furnace. Further, the temperature on the surface of the plate and the temperature at the center of the plate thickness just before the nip of the roll in each of the stands of the rough rolling mill were determined by heat conduction differential calculation starting from the mean value for the temperature in the direction of the plate thickness upon extraction from the heating furnace, and based on subsequent hysteresis such as contact with the roll, contact with coolants such as cooling water and spontaneous cooling.

Figure 2:
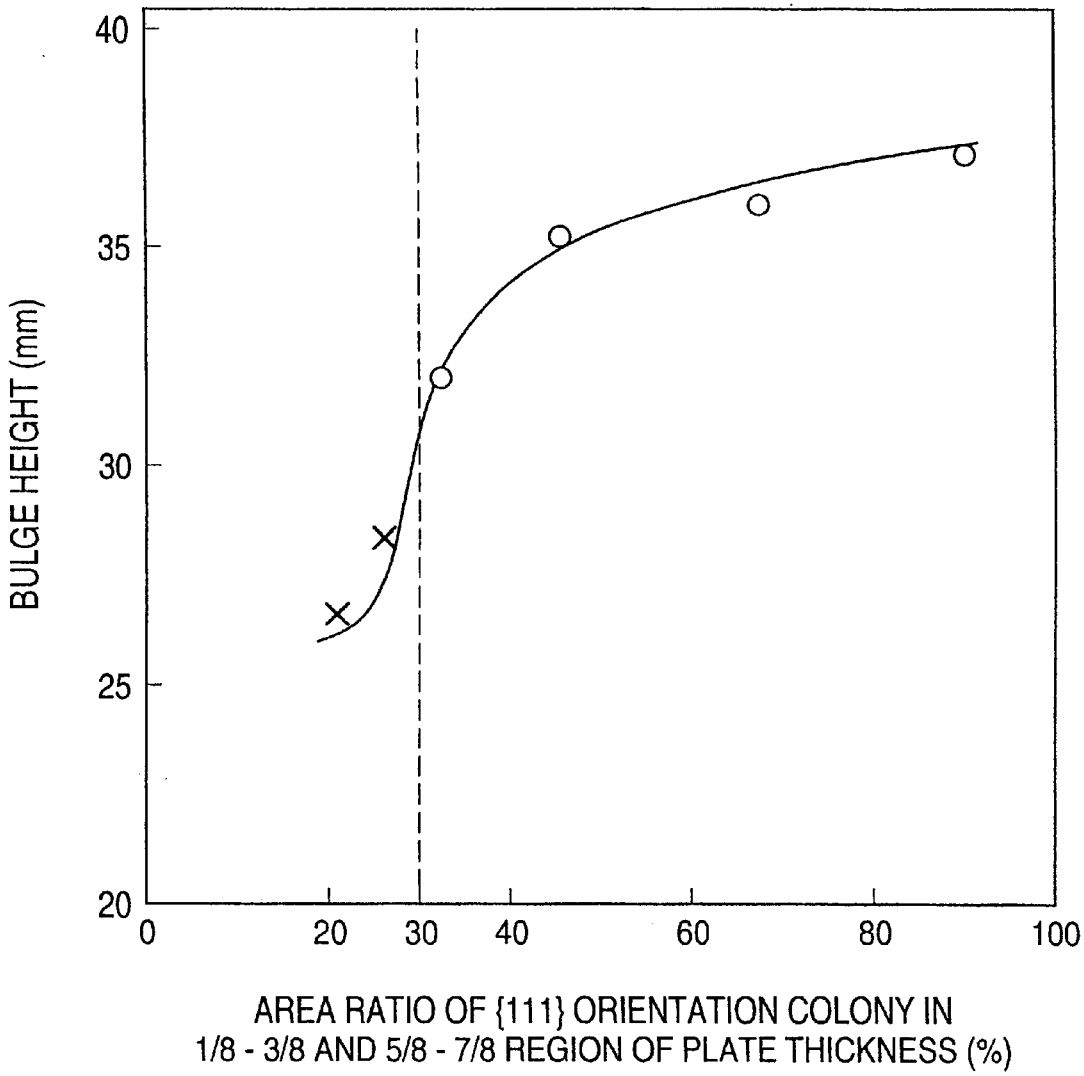
FIG. 2 is a graph illustrating the relationship between the area ratio of the {111} orientation colony in the regions of ⅛ to ⅜ and ⅝ to ⅞ of the plate thickness, and the ridging height and the bulging height.

To obtain the results, examination was made regarding the effect of the ratio of the {111} orientation colonies in the ⅛ to ⅜ regions and the ⅝ to ⅞ regions of the plate thickness within the cross section in the direction of the plate thickness. The effects on the deep drawing properties and the ridging resistance (evaluated by the ridging height) for the thus obtained rolled annealed plates are shown in FIG. 1 using "steel A" in Table 1. The result of the examination regarding the effect of the {111} orientation colony area ratio in the ⅛ to ⅜ regions and the ⅝ to ⅞ regions of the plate thickness on the bulging height is shown in FIG. 2.

Figure 6:
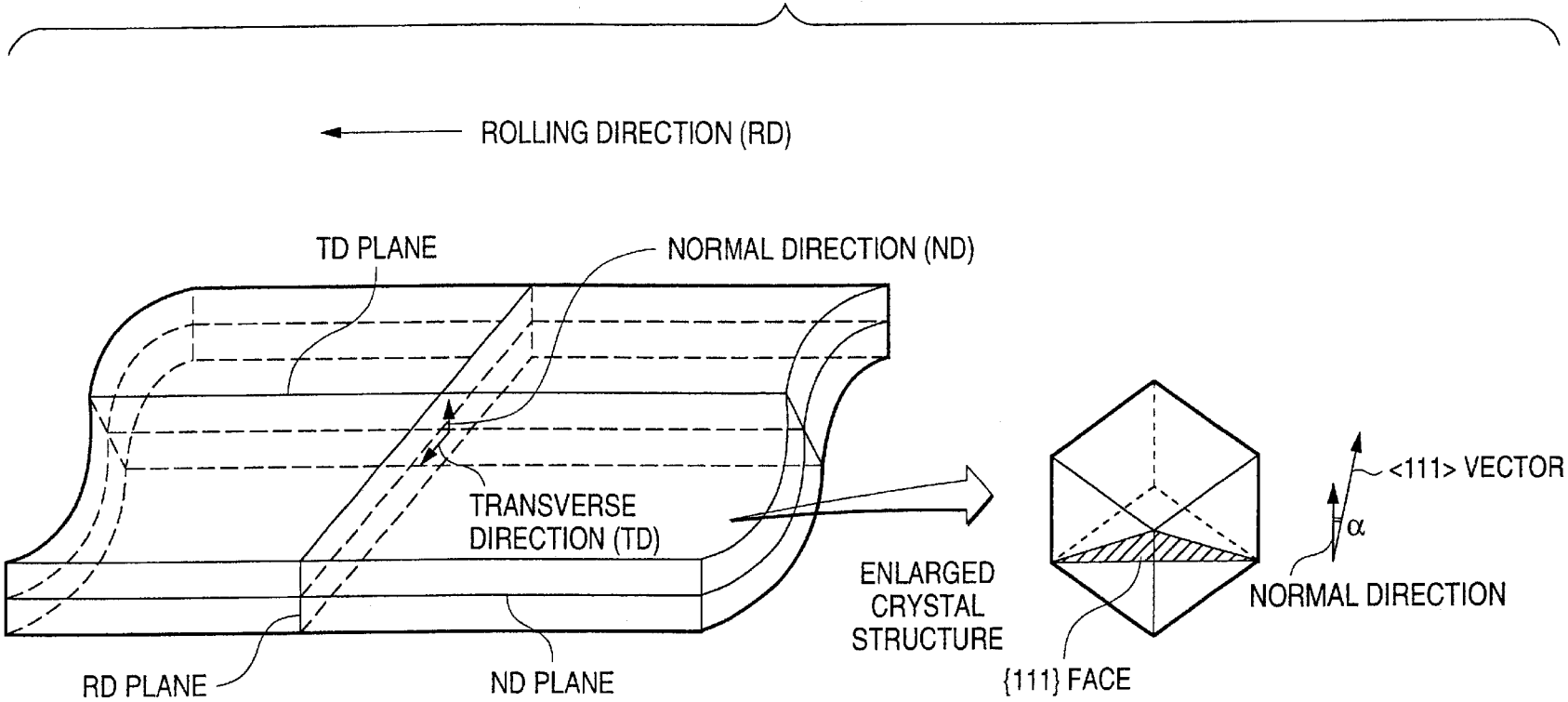
FIG. 6 is an explanatory view showing each of the directions and planes of the RD (Rolling Direction), the TD (Transverse Direction), and the ND (Normal Direction).

An {111} orientation colony is an assembly of adjacent crystals, which means an assembly of adjacent crystals in which the <111> orientation vector for each crystal is within 15° of an angle α relative to the orientation vector vertical to the rolling surface (ND orientation). For the {111} orientation colony, the orientation of the crystals in the cross section in the direction of the plate thickness (the TD plane referred to in FIG. 6) cut along the direction of rolling at the widthwise center of the steel plate at a 1 μm measuring distance, by the EBSD (Electron Back Scattering Diffraction) method, to determine the area ratio of the {111} orientation colony in the ⅛ to ⅜ region and in the ⅝ to ⅞ region of the plate thickness. Since it is generally considered that the orientation colony of the hot rolled plate is extended in the rolling direction and is cut along the rolling direction, so as to easily find the orientation colony by cutting along the rolling direction.

Further, the mean crystal grain size, the deep drawing properties, the ridging resistance and the bulging properties were measured by the methods discussed below.

Determination of properties of the plates are now described.

Mean Crystal Grain Size

The mean crystal grain size was determined by cutting, using an optical microscope, drawing lines each at 10 μm intervals on a microscopic photograph, measuring the number of crystal grains on the lines, and taking the average value.

Deep Drawing Property

JIS(Japanese Industrial Standard) No. 13 B test specimens (sampled from three positions at the central portion of the plate width and at each of 200 mm points from the plate ends in the direction of the plate width on every 50 m interval along the length of the plate) were used and applied with 15% monoaxial preliminary tensile strain to determine the r value in each of the directions in accordance with the three point method ($r_L$, $r_D$, $r_C$), the r values for each of the sampled positions were calculated in accordance with the following equation and an average value was determined.

$$r=(r_L+2r_D+r_C)/4$$

in which $r_L$, $r_D$ and $r_C$ represent, respectively, r values in the rolling direction, and in a direction of 45° to the rolling direction, and in a direction of 90° to the rolling direction.

Ridging Resistance

After applying 20% tensile strain to JIS No. 5 test specimens sampled in the rolling direction (sampled from three positions at the central portion of the plate width and at each 200 mm point from the plate ends in the direction of the plate width, taken at every 50 m interval along the plate), the ridging height (μm) was measured using a surface roughness gauge, and the ridging resistance was represented by the maximum value among them. A lower ridging height provides a higher ridging resistance.

Bulging Property (Liquid Pressure Bulge Test) JIS G 1521

The test specimens were sampled from three positions, at the central portion of the plate width and at each 200 mm point from the plate ends in the direction of the plate width on every 50 m interval along the length of the plate. A liquid pressure bulge test was conducted at a clamping pressure of 980 kN using a 100 mmϕ circular die to determine the bulging height.

The following trend can be seen from FIG. 1. As the area ratio of the {111} orientation colony exceeds 30% in the ⅛ to ⅜ regions and the ⅝ to ⅞ regions of the plate thickness, the r value exceeds 1.3 and is stabilized at a high r value of about 1.5. Further, the ridging height is abruptly lowered in the region where the area ratio of the {111} orientation colony is 30% or more to about 4 μm or less, and the ridging resistance was improved.

Further, as shown in FIG. 2, when the area ratio of the {111} orientation colony in the ⅛ to ⅜ regions and in the ⅝ to ⅞ regions of the plate thickness exceed 30%, the bulging height exceeds 30 mm and it tends to be stabilized at a high value of about 37 mm.

Figure 3:
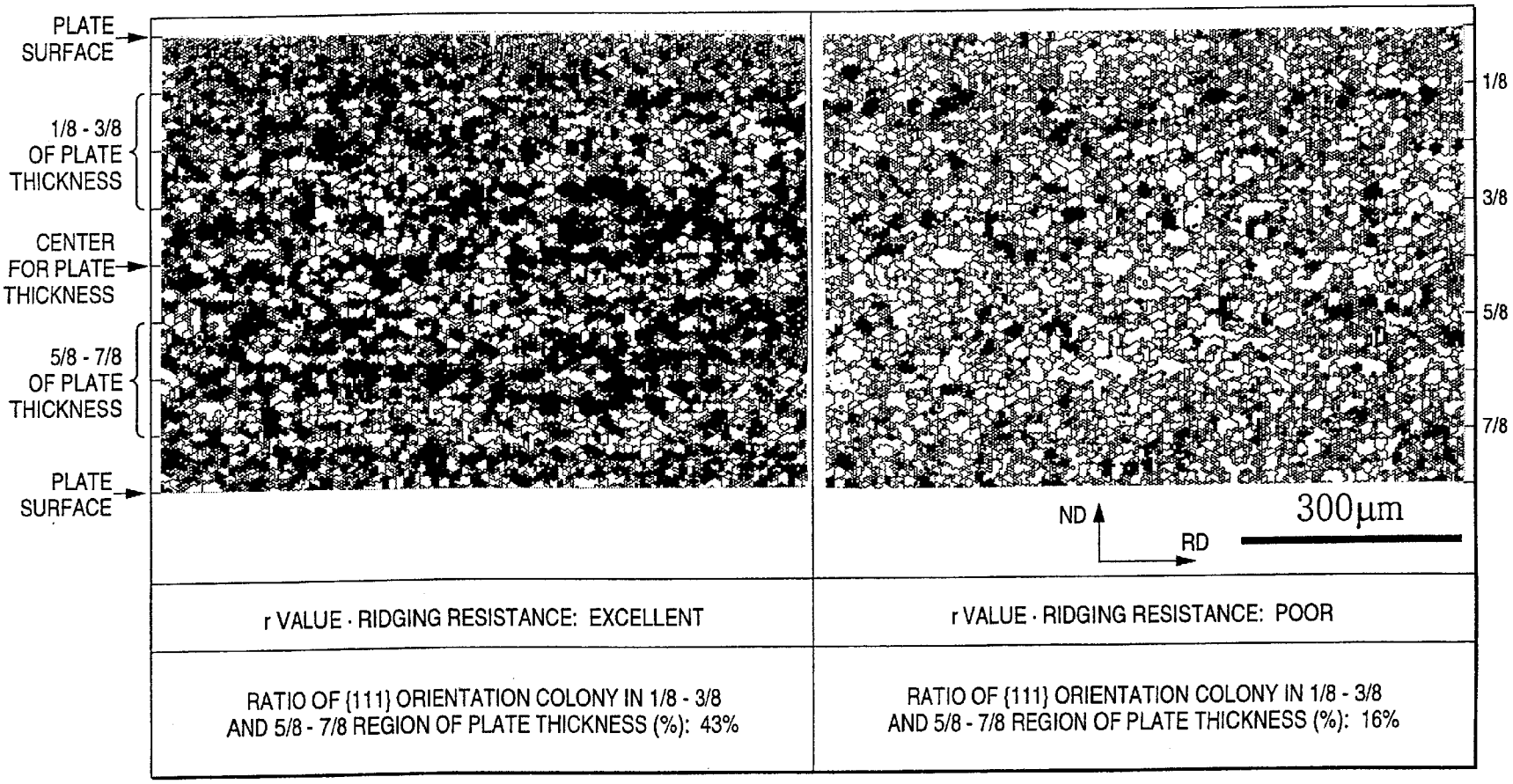
FIG. 3 is a microscopic view showing a cross section of a plate, and measurements of crystal orientation distribution by Electron Back Scattering Diffraction method (EBSD) for cold rolled annealed plates of the examples and comparative examples.

FIG. 3 shows an example of measurements of crystal orientation distribution for cold rolled annealed plates having excellent deep drawing and ridging properties (example of the invention) and cold rolled annealed plates having poor deep drawing properties and ridging resistance (comparative example), by sampling test specimens at a ½ position in the direction of the plate width and in an observing direction toward the plate width direction (TD direction) by the EBSD method over the entire plate thickness (0.6 mm). From FIG. 3, it can be seen that the existing ratio of the {111} orientation colony (the gray portion in the drawing) is high mainly in the ⅛ to ⅜ regions of the plate thickness and in the ⅝ to ⅞ regions of the plate thickness.

In FIG. 3, the showing appears gray when the angle α is formed between the orientation vector vertical to the rolling surface (ND direction in FIG. 6) and the <111> direction vector for each of crystals.

Further, the reason for defining the orientation distribution, the mean crystal grain size and the manufacturing method of ferritic stainless steel plates within the range described above in this invention, will be described.

Orientation distribution and surface for observing the mean crystal grain size in the rolling direction:

Since it is considered that each orientation colony in the hot rolled plate generally extends in the rolling direction, and that the orientation colonies can be found easily by cutting along the rolling direction, it is indeed cut in the rolling direction. However, in the event that this can be recognized as the orientation colony, cutting is not necessarily restricted exactly to the rolling direction.

Area ratio of {111} orientation colony in the ⅛ to ⅜ regions and in the ⅝ to ⅞ regions of the plate thickness: 30% or more For improving the deep drawing property, the ridging resistance and the bulging property, it is important to positively form the {111} orientation colony in the ⅛ to ⅜ regions and in the ⅝ to ⅞ regions of the plate thickness corresponding to the slab columnar crystal portion, which is also indispensable for the improvement of the bulging property.

As is shown in FIGS. 1 and 2, if the area ratios of the {111} orientation colonies, in the regions ⅛ to ⅜ and ⅝ to ⅞ of the plate thickness, is less than about 30%, the ridging height increases abruptly at about 20 μm or more and, the r value is lowered as less than 1.3 and the bulging height is also lowered as less than 30 mm. Particularly, the bulging height (FIG. 2) increases abruptly when the area ratio of the aforesaid {111} orientation colonies exceeds 30%. Accordingly, the area ratio of the {111} orientation colonies, in the regions between ⅛ to ⅜ and between ⅝ to ⅞ of the plate thickness, is defined as about 30% or more. More preferably, the area ratio is about 50% or more.

Mean crystal grain size: about 3 to 100 μm

The mean crystal grain size has an effect on the degree of occurrence of cracks upon bending. If the mean crystal grain size is fine as less than about 3 μm, this results in shortening of the annealing time of the cold rolled plate for preparing them in which recrystallization does not proceed sufficiently and strains caused in the steel during rolling are released upon bending tending to cause bending cracks. In coarse grains having a mean crystal grain size exceeding about 100 μm, cracks tend to occur during bending, and ductility is lowered. Therefore, the mean crystal grain size is defined within a range from about 3 to about 100 μm, preferably, about 3 to 60 μm. The mean crystal grain size can be controlled mainly by a finish annealing treatment, to be described later.

Figure 4:
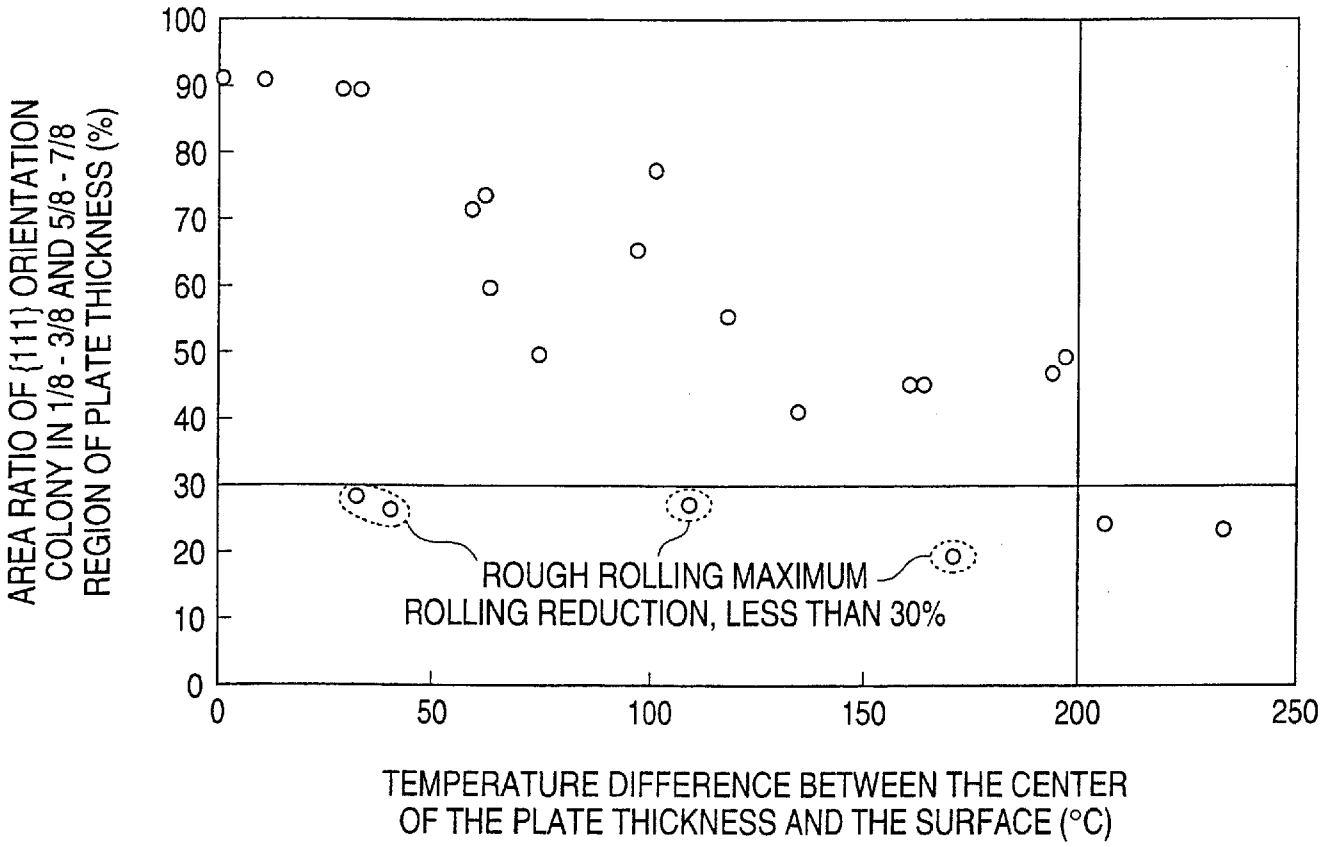
FIG. 4 is a graph illustrating the temperature difference between the center of the plate thickness and the surface, as related to the formation of the {111} orientation colonies in the regions between ⅛ to ⅜, and in the regions between ⅝ to ⅞ of the plate thickness.

Temperature difference between the center of the plate thickness and the plate surface: about 200° C. or lower FIG. 4 shows the relationship between the area ratio of the {111} orientation colonies in the ⅛ to ⅜ regions and in the ⅝ to ⅞ regions of the plate thickness of the cold rolled annealed plate and the temperature difference between the center of the plate thickness and the plate surface during hot rolling. It can be seen from FIG. 4 that the respective {111} orientation colonies are present in an area ratio of about 30% or more in each of the cold rolled annealed plates, within the range in which the temperature difference between the center of the plate thickness and the surfaces is in a range of about 200° C. or lower, except for those having the rough rolling maximum rolling reduction not reaching about 30%.

If the temperature difference between the center of the plate thickness and the surface just before the nip of the rolling roll exceeds about 200° C., it is considered that the {111} orientation colony can not be easily formed at about 30% or more since the behavior upon recrystallization differs greatly between the central portion of the plate thickness and the vicinity of the surface. Heat conduction to the roll occurs by rolling and a temperature distribution is applied to the rolled material in the direction of the plate thickness, in which the temperature difference, as maximized just after rolling, is averaged and reduced by the heat conduction in the direction of the plate thickness with lapse of time, and the temperature difference is reduced to zero after the lapse of a sufficient time (about 30 sec).

As described above, the temperature difference between the center of the plate thickness and the surface just before the nip of the rough rolling roll is caused by the previous pass, and the temperature difference is also caused by temperature distribution formed in the direction of the plate thickness during heating in a heating furnace, or caused by the coolant (usually, water), applied to the surface of the rolling material with an aim of descaling just before rough rolling. Further, the temperature difference is determined based on the rolling speed and the time until the temperature is averaged by heat conduction in the direction of the plate thickness.

Maximum rolling reduction per single pass of rough rolling: about 30% or more

Figure 5:
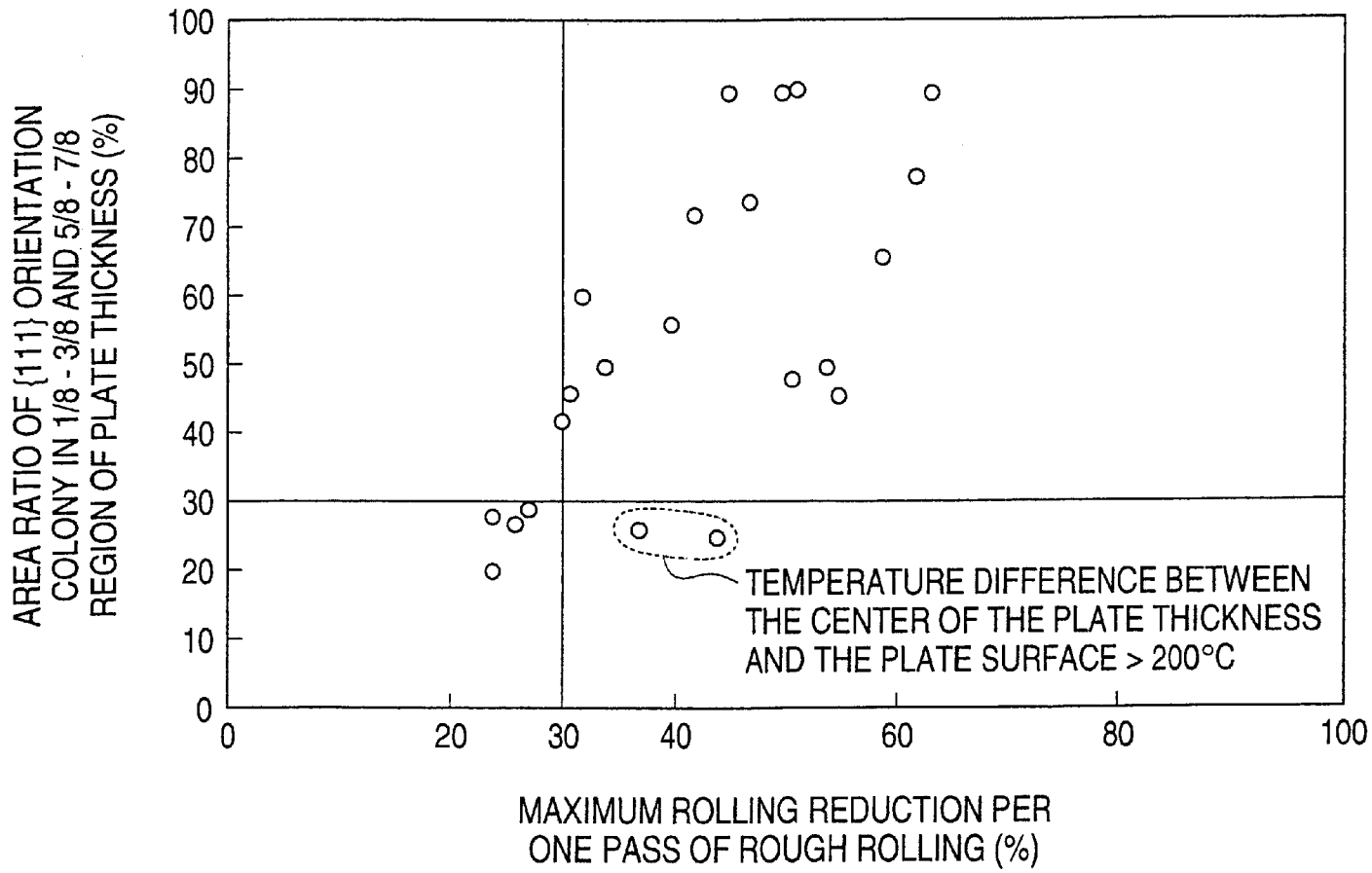
FIG. 5 is a graph illustrating the effect of the maximum rolling reduction per single pass of rough rolling on the formation of the {111} orientation colonies in the regions between ⅛ to ⅜ and between ⅝ to ⅞ of the plate thickness {111}.

From the result of the experiment described above, FIG. 5 shows a relationship between the area ratio of the {111} orientation colonies in the ⅛ to ⅜ and ⅝ to ⅞ regions and the maximum rolling reduction per single pass of rough rolling. It can be seen from FIG. 5 that the {111} orientation colonies having an area ratio of 30% or more are formed in the aforementioned regions of ⅛ to ⅜ and ⅝ to ⅞ of the plate thickness. From the foregoing, it is necessary to make the maximum rolling reduction, at least per single pass, about 30% or more in the rough rolling step in order to ensure an area ratio of the {111} orientation colonies by about 30% or more in the ⅛ to ⅜ regions and in the ⅝ and ⅞ regions of the plate thickness.

Finish annealing: about 700 to 1100° C., within about 300 sec.

For controlling the mean crystal grain size to a range of about 3 to 100 μm defined in this invention, the finish annealing condition is preferably set to an optimal condition. If the temperature for the finish annealing is lower than about 700° C., recrystallization does not extend completely into the central portion of the steel plate, and it is difficult to obtain sufficient formability, particularly bendability. Further, if it is annealed at a temperature exceeding about 1100° C., the crystal grain is grown coarser than required, tending to cause cracks upon bending. Also in a case where the annealing time exceeds about 300 sec, the crystal grains also become coarser, worsening bendability. Accordingly, the finish annealing is desirably conducted within a temperature range from about 700 to 1100° C., preferably, about 800 to 1000° C., and within a time of about 300 sec or less, preferably, about 10 to 90 sec.

This invention is applicable with no problems to ferritic stainless steels of various chemical compositions and, particularly, applicable also to ferritic stainless steels with no particular requirements of specific chemical compositions, including C, N, or with no addition of Ti or Nb, or no need for high purification or Mn/Si control, for example.

Concrete chemical compositions to which this invention is applicable advantageously can include (mass % basis), 0.1% or less of C, 1.5% or less of Si, 1.5% or less of Mn, 5 to 50% of Cr, 2.0% or less of Ni, 0.08% or less of P, 0.02% or less of S, and 0.1% or less of N and, optionally, one or more of elements selected from 0.5% or less of Nb, 0.5% or less of Ti, 0.2% or less of Al, 0.3% or less of V, 0.3% or less of Zr, 2.5% or less of Mo, 2.5% or less of Cu, 2.0% or less of W, 0.1% or less of REM, 0.05% or less of B, 0.02% or less of Ca and 0.02% or less of Mg, and the balance of Fe and inevitable impurities.

In addition, it is preferred in this invention that the slab heating temperature in the hot rolling is from about 1000 to 1300° C. and, preferably, from about 1100 to 1200° C. in view of the surface property and that the rolling temperature is from about 600 to 1000° C., preferably, from about 700 to 950° C. as the temperature at the finish rolling exit in view of the surface property and ensure for the workability. Further, annealing for the hot rolled plate is preferably conducted at about 700 to 1100° C. for about 10 sec to 10 hours depending on the kind of steel. Further, while the cold rolling may be finished in accordance with the plate thickness of the products, the cold rolling reduction is preferably about 50% or more with a reason of further improving the pressing workability.

EXAMPLES

The following examples are not intended to define, or to limit, the scope of the invention as defined in the claims.

Ferritic stainless steels comprising the chemical compositions and the substantial balance of Fe shown in Table 1 were prepared by melting each into a continuously cast slab of 200 mm thickness, heated to 1170° C. and then hot rolled, comprising 6 passes of rough rolling and 7 passes of finish rolling, to prepare hot rolled plates of 4.0 mm plate thickness. In this case, the maximum rolling reduction of the rough rolling step was varied in the range from 24 to 63%, and the temperature difference between the center of the plate thickness and the plate surface just before the rolling roll nip, in the pass for maximum rolling reduction, was changed variously within a range of 233° C. or lower. The method of determining the temperature difference between the center of the plate thickness and the surface was already described above. The temperature difference between the center of the plate thickness and the plate surface was mainly controlled by adjusting the amount of cooling water between 0 to 6800 liters/min/m, and rough rolling was conducted within the range of the roll diameter of 500 to 1500 mm and the roll speed of 50 to 500 m/min. Then, hot rolled plates were annealed at 850° C. for 8 hours or at 900 to 960° C. for one min and after cold rolling, finish annealing was conducted while changing the temperature and the time within various ranges to form cold rolled annealed plates of 0.6 mm plate thickness.

For the thus obtained steel plates, the area ratio of {111} orientation colony in the two regions comprising ⅛ to ⅜ and ⅝ to ⅞ of the plate thickness, and the mean crystal grain size within a cross section vertical to the plate width were measured, respectively. The results are shown together with the deep drawing property (r value), the bulging height, the bendability (occurrence of cracks) and the maximum ridging height in Tables 2, 3 and 4.

For the area ratio of the {111} orientation colony, the crystal orientation in the cross section of the entire plate thickness (0.6 mm)×rolling direction 0.9 mm by the EBSD method was measured to determine the area ratio of the {111} orientation colony in the each of the regions ⅛ to ⅜ and ⅝ to ⅞.

Further, bendability was evaluated by applying a 20% tensile strain to JIS No. 5 test specimens sampled in the rolling direction and then conducting complete contact bending at 180°, and based on the absence or presence of cracks formed in the bent portion. Further, the deep drawing property (r value), the maximum ridging height and the bulging height were measured in accordance with the same methods as those explained for the result of the experiment.

As shown in Table 2 to Table 4, it can be seen that examples of the invention had excellent deep drawing properties (r value), bulging properties, bendability and ridging resistance, compared with those of the comparative examples.

As has been described above, we have discovered how to provide ferritic stainless steel plates that have excellent ridging resistance and formability by controlling the rough rolling in the hot rolling procedure to ensure the important area ratio of the {111} orientation colonies in the regions ⅛ to ⅜ and ⅝ to ⅞ of the plate thickness, by about 30% or more.

Further, according to this invention, since the foregoing effects can be obtained in ferritic stainless steels including general purpose steels such as SUS430 with no particular requirements of special chemical compositions, particularly, reduction of C or N, addition of Ti or Nb and the like This invention greatly contributes to the enjoyment of a stable supply of ferritic stainless steel plates at reduced cost, and having excellent characteristics.

TABLE 1

(mass %)

| Kind of steel | C | Si | Mn | P | S | Cr | Ni | Al | N | Ti | Nb | B | Mo |
|---|---|---|---|---|---|---|---|---|---|---|---|---|---|
| A | 0.0560 | 0.3340 | 0.6505 | 0.0350 | 0.0083 | 16.11 | 0.3701 | 0.0012 | 0.0274 | — | — | — | — |
| B | 0.0481 | 0.5500 | 0.7590 | 0.0218 | 0.0033 | 16.83 | 0.3211 | 0.0084 | 0.0154 | — | — | — | — |
| C | 0.0682 | 0.6810 | 0.3822 | 0.0190 | 0.0048 | 16.79 | 0.5933 | 0.0100 | 0.0051 | — | — | — | — |
| D | 0.0119 | 0.2241 | 0.6996 | 0.0362 | 0.0038 | 11.26 | 0.0050 | 0.0246 | 0.0085 | 0.15 | — | — | — |
| E | 0.0035 | 0.3495 | 0.2119 | 0.0255 | 0.0021 | 18.18 | 0.1163 | 0.0109 | 0.0124 | 0.21 | — | 0.0011 | 1.2 |
| F | 0.0034 | 0.4411 | 0.2325 | 0.0209 | 0.0036 | 30.20 | 0.0927 | 0.0155 | 0.0068 | 0.21 | 0.006 | — | 2.1 |
| G | 0.0507 | 0.3996 | 0.7094 | 0.0274 | 0.0080 | 17.45 | 0.0347 | 0.0033 | 0.0173 | — | 0.410 | — | — |

TABLE 2

| No. | Kind of steel | Heating temperature (° C.) | Descaling water amount (1/min/m) | Roll diameter of rough rolling for max. rolling reduction (mm) | Roll speed of rough rolling for max. rolling reduction (m/min) | Max. rolling reduction of rough rolling (%) | Temperature difference between plate thickness center and surface layer just before roll nipping of rolling pass for max. rolling reduction (° C.) | Finish roll exit temperature (° C.) | Hot rolling anneal temperature (° C.) |
|---|---|---|---|---|---|---|---|---|---|
| 1 | A | 1179 | 600 | 826 | 380 | 26 | 40 | 994 | 850 |
| 2 | A | 1172 | 4200 | 588 | 400 | 24 | 171 | 993 | 850 |
| 2' | A | 1172 | 4200 | 588 | 400 | 24 | 171 | 993 | 850 |
| 3 | A | 1170 | 2200 | 1107 | 210 | 32 | 63 | 995 | 850 |
| 3' | A | 1170 | 2200 | 1107 | 210 | 32 | 63 | 995 | 850 |
| 4 | A | 1180 | 6800 | 1326 | 420 | 31 | 164 | 998 | 850 |
| 4' | A | 1180 | 6800 | 1326 | 420 | 31 | 164 | 998 | 850 |
| 5 | A | 1179 | 4900 | 758 | 480 | 44 | 233 | 997 | 850 |
| 5' | A | 1179 | 4900 | 758 | 480 | 44 | 233 | 997 | 850 |
| 6 | A | 1170 | 0 | 1107 | 210 | 45 | 10 | 990 | 850 |
| 7 | A | 1170 | 0 | 1107 | 210 | 26 | 10 | 990 | 850 |
| 8 | B | 1175 | 200 | 1433 | 140 | 63 | 28 | 995 | 850 |
| 8' | B | 1175 | 200 | 1433 | 140 | 63 | 28 | 995 | 850 |

| No. | Kind of steel | Hot rolling anneal time (min) | Cold roll reduction (%) | Finish anneal temperature (° C.) | Finish anneal time (sec) | Area ratio of {111} orientation colony in ⅛–⅜, ⅝–⅞ region of plate thickness (%) | r value | Max. ridging height (μm) | Bulging height (mm) | Mean crystal grain size (μm) | Cracks | Remark |
|---|---|---|---|---|---|---|---|---|---|---|---|---|
| 1 | A | 480 | 85 | 850 | 60 | 27 | 1.18 | 27.0 | 25.5 | 15 | N | Comparative Example |

TABLE 2-continued

| | | | | | | | | | | | | |
|---|---|---|---|---|---|---|---|---|---|---|---|---|
| 2 | A | 480 | 85 | 850 | 60 | 20 | 0.80 | 31.0 | 24.0 | 15 | N | Comparative Example |
| 2' | A | 480 | 87 | 690 | 60 | 20 | 0.78 | 31.1 | 24.0 | 1 | Y | Comparative Example |
| 3 | A | 480 | 85 | 850 | 60 | 50 | 1.45 | 3.6 | 36.6 | 15 | N | Example of invention |
| 3' | A | 480 | 85 | 701 | 37 | 60 | 1.46 | 3.5 | 36.8 | 3 | N | Example of invention |
| 4 | A | 480 | 85 | 850 | 60 | 46 | 1.38 | 4.2 | 34.5 | 15 | N | Example of invention |
| 4' | A | 480 | 90 | 903 | 290 | 46 | 1.35 | 4.4 | 34.2 | 95 | N | Example of invention |
| 5 | A | 480 | 85 | 850 | 60 | 25 | 1.11 | 30.0 | 25.1 | 15 | N | Comparative Example |
| 5' | A | 480 | 81 | 923 | 5 | 25 | 1.13 | 30.0 | 25.3 | 8 | N | Comparative Example |
| 6 | A | 480 | 86 | 850 | 60 | 90 | 1.41 | 3.2 | 35.2 | 15 | N | Example of invention |
| 7 | A | 480 | 80 | 705 | 320 | 28 | 1.08 | 26.6 | 24.8 | 108 | Y | Comparative Example |
| 8 | B | 480 | 85 | 850 | 60 | 90 | 1.48 | 2.6 | 38.5 | 17 | N | Example of invention |
| 8' | B | 480 | 85 | 1103 | 26 | 90 | 1.45 | 2.8 | 37.9 | 106 | Y | Comparative Example |

TABLE 3

| No. | Kind of steel | Heating temperature (° C.) | Descaling water amount (1/min/m) | Roll diameter of rough rolling for max. rolling reduction (mm) | Roll speed of rough rolling for max. rolling reduction (m/min) | Max. rolling reduction of rough rolling (%) | Temperature difference between plate thickness center and surface layer just before roll nipping of rolling pass for max. rolling reduction (° C.) | Finish roll exit temperature (° C.) | Hot rolling anneal temperature (° C.) |
|---|---|---|---|---|---|---|---|---|---|
| 9 | B | 1176 | 2700 | 1395 | 300 | 59 | 97 | 992 | 850 |
| 9' | B | 1176 | 2700 | 1395 | 300 | 59 | 97 | 992 | 850 |
| 10 | C | 1177 | 5000 | 1080 | 490 | 54 | 197 | 992 | 850 |
| 10' | C | 1177 | 5000 | 1080 | 490 | 54 | 197 | 992 | 850 |
| 11 | C | 1178 | 800 | 1240 | 460 | 27 | 32 | 1000 | 850 |
| 12 | C | 1179 | 1000 | 1424 | 320 | 50 | 32 | 990 | 850 |
| 12' | C | 1179 | 1000 | 1424 | 320 | 50 | 32 | 990 | 850 |
| 13 | D | 1173 | 1700 | 1282 | 490 | 42 | 59 | 907 | 900 |
| 14 | D | 1173 | 1700 | 1282 | 490 | 27 | 59 | 907 | 900 |
| 15 | D | 1175 | 1300 | 603 | 110 | 47 | 62 | 949 | 900 |
| 15' | D | 1175 | 1300 | 603 | 110 | 47 | 62 | 949 | 900 |
| 16 | D | 1170 | 0 | 758 | 480 | 50 | 0 | 920 | 900 |
| 16' | D | 1170 | 0 | 758 | 480 | 50 | 0 | 920 | 900 |

| No. | Kind of steel | Hot rolling anneal time (min) | Cold roll reduction (%) | Finish anneal temperature (° C.) | Finish anneal time (sec) | Area ratio of {111} orientation colony in ⅛–⅜, ⅝–⅞ region of plate thickness (%) | r value | Max. ridging height (μm) | Bulging height (mm) | Mean crystal grain size (μm) | Cracks | Remark |
|---|---|---|---|---|---|---|---|---|---|---|---|---|
| 9 | B | 480 | 85 | 850 | 60 | 66 | 1.46 | 2.9 | 37.4 | 17 | N | Example of invention |
| 9' | B | 480 | 82 | 901 | 109 | 66 | 1.45 | 2.9 | 37.3 | 32 | N | Example of invention |
| 10 | C | 480 | 85 | 850 | 60 | 50 | 1.42 | 3.2 | 35.3 | 17 | N | Example of invention |
| 10' | C | 480 | 86 | 964 | 159 | 50 | 1.41 | 3.2 | 35.2 | 66 | N | Example of invention |
| 11 | C | 480 | 85 | 850 | 60 | 29 | 1.28 | 6.0 | 26.2 | 16 | N | Comparative Example |
| 12 | C | 480 | 85 | 850 | 60 | 90 | 1.48 | 3.1 | 37.7 | 16 | N | Example of invention |
| 12' | C | 480 | 85 | 826 | 26 | 90 | 1.48 | 3.1 | 37.7 | 11 | N | Example of invention |
| 13 | D | 1 | 85 | 910 | 60 | 72 | 1.97 | 1.5 | 39.1 | 17 | N | Example of invention |
| 14 | D | 1 | 83 | 910 | 305 | 27 | 1.65 | 29.6 | 28.7 | 112 | Y | Comparative Example |
| 15 | D | 1 | 85 | 910 | 60 | 74 | 1.99 | 1.2 | 39.8 | 17 | N | Example of invention |

TABLE 3-continued

| | | | | | | | | | | | | |
|---|---|---|---|---|---|---|---|---|---|---|---|---|
| 15' | D | 1 | 89 | 906 | 163 | 74 | 1.98 | 1.2 | 39.7 | 44 | N | Example of invention |
| 16 | D | 1 | 85 | 910 | 60 | 90 | 2.05 | 1.3 | 40.2 | 17 | N | Example of invention |
| 16' | D | 1 | 79 | 854 | 61 | 90 | 2.05 | 1.3 | 40.2 | 13 | N | Example of invention |

TABLE 4

| No. | Kind of steel | Heating temperature (° C.) | Descaling water amount (1/min/m) | Roll diameter of rough rolling for max. rolling reduction (mm) | Roll speed of rough rolling for max. rolling reduction (m/min) | Max. rolling reduction of rough rolling (%) | Temperature difference between plate thickness center and surface layer just before roll nipping of rolling pass for max. rolling reduction (° C.) | Finish roll exit temperature (° C.) | Hot rolling anneal temperature (° C.) |
|---|---|---|---|---|---|---|---|---|---|
| 17 | E | 1174 | 2400 | 880 | 150 | 34 | 74 | 949 | 950 |
| 18 | E | 1174 | 2400 | 880 | 150 | 28 | 74 | 949 | 950 |
| 19 | E | 1174 | 3100 | 1101 | 150 | 62 | 101 | 932 | 950 |
| 19' | E | 1174 | 3100 | 1101 | 150 | 62 | 101 | 932 | 950 |
| 20 | E | 1176 | 4000 | 1224 | 80 | 24 | 109 | 933 | 950 |
| 21 | F | 1170 | 3000 | 688 | 243 | 40 | 112 | 935 | 950 |
| 21' | F | 1170 | 3000 | 688 | 243 | 40 | 112 | 935 | 950 |
| 22 | F | 1171 | 3500 | 1007 | 272 | 30 | 134 | 940 | 950 |
| 23 | F | 1171 | 3500 | 1007 | 272 | 28 | 134 | 940 | 950 |
| 24 | G | 1174 | 3400 | 504 | 270 | 55 | 162 | 926 | 960 |
| 24' | G | 1174 | 3400 | 504 | 270 | 55 | 162 | 926 | 960 |
| 25 | G | 1172 | 5100 | 1419 | 170 | 51 | 194 | 914 | 960 |
| 25' | G | 1172 | 5100 | 1419 | 170 | 51 | 194 | 914 | 960 |
| 26 | G | 1179 | 5900 | 1223 | 260 | 37 | 206 | 941 | 960 |

| No. | Kind of steel | Hot rolling anneal time (min) | Cold roll reduction (%) | Finish anneal temperature (° C.) | Finish anneal time (sec) | Area ratio of {111} orientation colony in ⅛–⅜, ⅝–⅞ region of plate thickness (%) | r value | Max. ridging height (μm) | Bulging height (mm) | Mean crystal grain size (μm) | Cracks | Remark |
|---|---|---|---|---|---|---|---|---|---|---|---|---|
| 17 | E | 1 | 85 | 950 | 60 | 50 | 2.01 | 3.0 | 40.7 | 18 | N | Example of invention |
| 18 | E | 1 | 82 | 598 | 10 | 28 | 1.64 | 33.1 | 30.8 | 1 | Y | Comparative Example |
| 19 | E | 1 | 85 | 950 | 60 | 78 | 2.15 | 2.4 | 41.1 | 18 | N | Example of invention |
| 19' | E | 1 | 85 | 849 | 127 | 78 | 2.14 | 2.4 | 41.0 | 45 | N | Example of invention |
| 20 | E | 1 | 85 | 950 | 60 | 28 | 1.48 | 32.0 | 27.5 | 18 | N | Comparative Example |
| 21 | F | 1 | 85 | 950 | 60 | 56 | 1.84 | 2.5 | 38.7 | 17 | N | Example of invention |
| 21' | F | 1 | 88 | 1088 | 281 | 56 | 1.82 | 2.7 | 38.4 | 95 | N | Example of invention |
| 22 | F | 1 | 85 | 950 | 60 | 42 | 1.80 | 2.4 | 39.0 | 17 | N | Example of invention |
| 23 | F | 1 | 86 | 1125 | 324 | 28 | 1.30 | 32.5 | 28.4 | 157 | Y | Comparative Example |
| 24 | G | 1 | 85 | 980 | 60 | 46 | 1.00 | 2.5 | 36.2 | 18 | N | Example of invention |
| 24' | G | 1 | 91 | 980 | 67 | 46 | 0.90 | 2.5 | 36.0 | 30 | N | Example of invention |
| 25 | G | 1 | 85 | 980 | 60 | 48 | 1.20 | 2.7 | 35.1 | 18 | N | Example of invention |
| 25' | G | 1 | 80 | 859 | 109 | 48 | 1.10 | 2.7 | 35.0 | 57 | N | Example of invention |
| 26 | G | 1 | 85 | 980 | 60 | 26 | 0.70 | 33.0 | 24.3 | 18 | N | Comparative Example |

What is claimed is:

1. A method of manufacturing a ferritic stainless steel plate having excellent ridging resistance and formability, comprising:

rough rolling and finish rolling slabs in hot rolling, applying annealing and cold rolling to the resulting hot rolled plates, and applying finish annealing, wherein said rolling is conducted at a rolling reduction in at least one pass in said rough rolling step of said hot rolling of about 30% or more, and maintaining a temperature difference between the center of said plate thickness and the plate surface of about 200° C. or less in said pass where said rolling reduction is maximum.

2. A method of manufacturing a ferritic stainless steel plate as defined in claim 1, wherein said finish annealing is performed at an annealing temperature of from about 700 to 1100° C. and during an annealing time of about 300 sec or less.

3. A method of manufacturing a ferritic stainless steel plate as defined in claim 2, wherein said annealing temperature is from about 800 to 1000° C. and said annealing time is about 10 to 90 sec.

4. A method of manufacturing a ferritic stainless steel plate having excellent ridging resistance and formability, comprising:

rough rolling and finish rolling slabs in hot rolling, applying annealing and cold rolling to the resulting hot rolled plates, and applying finish annealing, wherein said rolling is conducted at a rolling reduction in at least one pass in said rough rolling step of said hot rolling of about 30% or more, and maintaining a temperature difference between the center of said plate thickness and the plate surface of about 200° C. or less in said pass where said rolling reduction is maximum by controlling an amount of coolant applied to the plate and/or rolling speed.

5. A method of manufacturing a ferritic stainless steel plate as defined in claim 4, wherein said finish annealing is performed at an annealing temperature of from about 700 to 1100° C. and during an annealing time of about 300 sec or less.

6. A method of manufacturing a ferritic stainless steel plate as defined in claim 5, wherein said annealing temperature is from about 800 to 1000° C. and said annealing time is about 10 to 90 sec.

* * * * *